US005491947A

United States Patent [19]

Kim

[11] Patent Number: 5,491,947

[45] Date of Patent: Feb. 20, 1996

[54] FORM-FILL CONCRETE WALL

[76] Inventor: Sun Y. Kim, 2384 Lancaster Ct., Hayward, Calif. 94542

[21] Appl. No.: 222,631

[22] Filed: Mar. 24, 1994

[51] Int. Cl.[6] ..... E04B 2/28; E04B 2/32

[52] U.S. Cl. ..... 52/426; 52/309.15; 52/562; 52/563

[58] Field of Search ..... 52/426, 425, 424, 52/415, 421, 422, 562, 563, 565, 309.14, 428, 417, 564, 442, 309.11, 568, 569, 309.15; 249/45, 44, 47

[56] References Cited

U.S. PATENT DOCUMENTS

| | | | |
|---|---|---|---|
| 2,164,681 | 7/1939 | Fould | 52/568 |
| 2,316,819 | 4/1943 | Tedrow | 52/564 |
| 4,180,956 | 1/1980 | Gross | 52/563 |
| 4,263,765 | 4/1981 | Maloney | 52/426 X |
| 4,433,522 | 2/1984 | Yerushalmi | 52/426 |
| 4,730,422 | 3/1988 | Young | 52/426 X |
| 4,879,855 | 11/1989 | Berrenberg | 52/426 X |
| 5,024,035 | 6/1991 | Hanson et al. | 52/309.12 X |
| 5,311,718 | 5/1994 | Trousilek | 52/425 |

*Primary Examiner*—Carl D. Friedman
*Assistant Examiner*—Kien T. Nguyen
*Attorney, Agent, or Firm*—Bielen, Peterson & Lampe

[57] ABSTRACT

A form-fill concrete wall system assembled from a plurality of connected wall panels forming the inside and outside sheath of a wall structure, the inside and outside panels being connected along their side edges to form the inside sheath and the outside sheath, and being interconnected by a series of cross webs that maintain the panels in a spaced relationship wherein concrete fills the space between the inside sheath and outside sheath to form the wall structure, the cross webs being replaceable and selected in part to define the thickness of the wall structure.

14 Claims, 4 Drawing Sheets

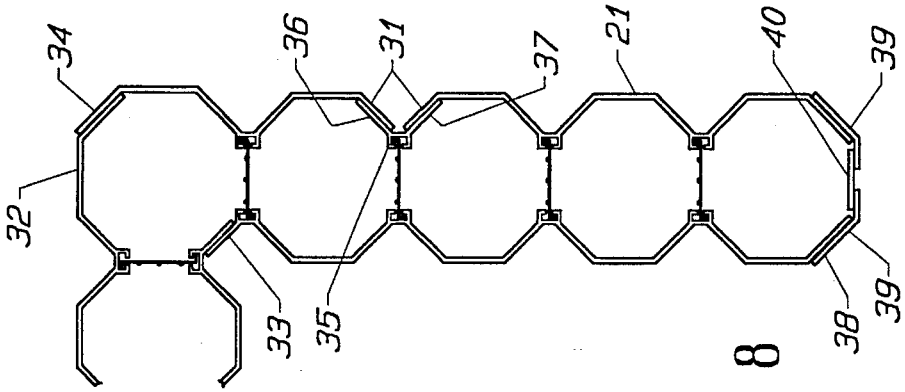
FIG. 8
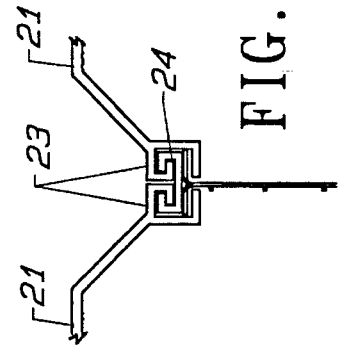
FIG. 3B
FIG. 3D
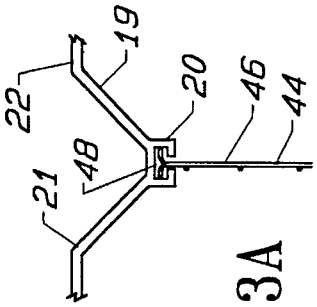
FIG. 3A
FIG. 3C
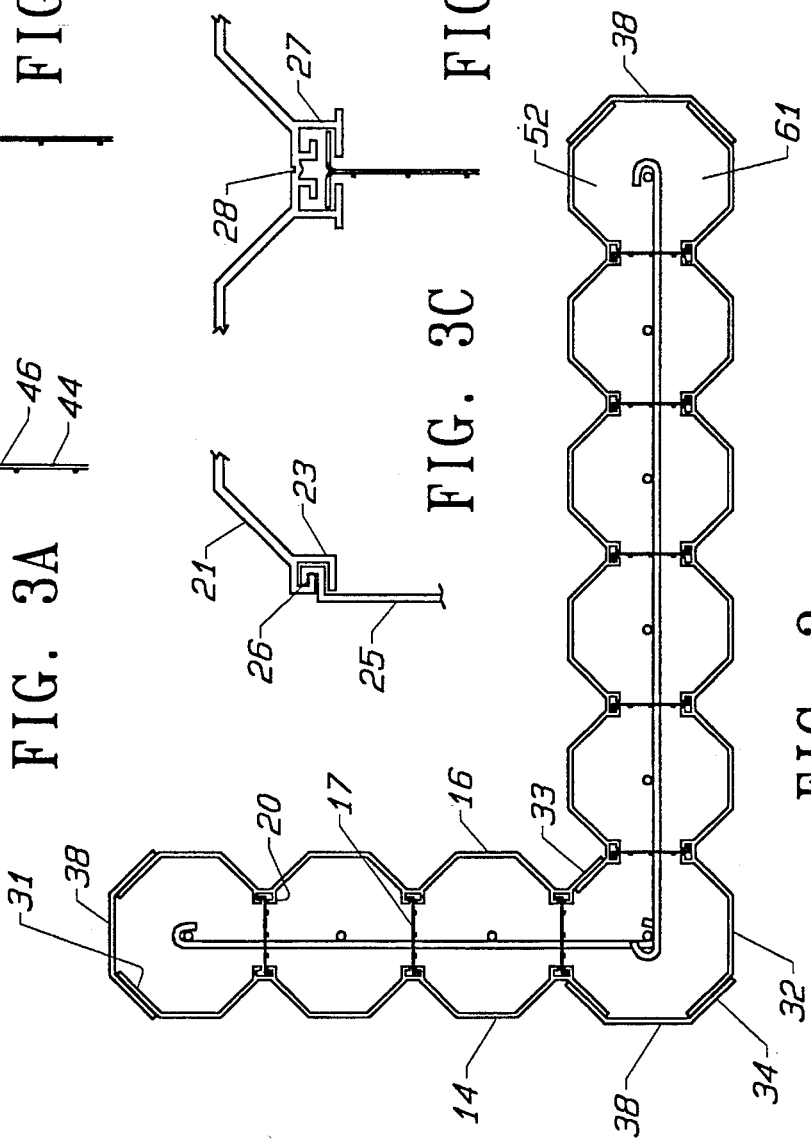
FIG. 2

FORM-FILL CONCRETE WALL

BACKGROUND OF THE INVENTION

This invention relates to a form-fill concrete wall and in particular to lock-together form that is fabricated from a light weight material. The material of the form preferably has certain advantageous characteristics, wherein the form is filled with concrete and the form becomes part of the resulting wall. Although permanent, in-place forms have be devised for concrete structures, it is generally required that these forms be erected around a preconstructed matrix of reinforcing steel. Such forms, with front and back shells, are tied together on each side of the erected reinforcing steel, after the steel rod has been tied together in a free standing lattice. While certain advantages of such construction are apparent, the set up time is not substantially less than for conventional concrete forming systems.

A prior art, snap-together form with fixed cross webs has been marketed. However, the fixed cross webs limit the use to a predefined wall thickness and horizontal reinforcing steel is difficult to install. Furthermore, the cross webs are fabricated from the same material as the shell. When a preferred plastic material is used for this shell, the plastic cross webs are structurally unacceptable.

The invented, in-place form system, has the advantage over conventional systems of enabling an outside sheath to encapsulate the concrete and to remain in-place after the concrete has set. The outside sheath can have either weather resistent qualities alone, or can have certain composition characteristics that make the sheathing ideal as an interior liner for containing liquid chemicals or granular minerals that may degrade the surface of conventional concrete. In this manner, a structure formed with the form as an outer sheathing forming the inside and outside wall surface can be utilized in waste treatment plants, chemical compounds, and retaining walls for minerals. For example, prilled elemental sulfur may generate local acid conditions on oxidation and result in a chemical reaction with calcium in cement. An acid resistent plastic sheathing would contain the sulfur prill without degradation of either the prill or the retaining wall.

A principle advantage in the proposed system, is that the form sheath can be erected using differently configured, and differently sized cross webs to enable walls of different thickness and height to be erected. In addition, the cross webs are designed to facilitate placement of horizontal reinforcing steel. Furthermore, the different configurations of the cross webs can provide for improved flow of the poured concrete through the webs in narrow walls. For maximized flow-through, the webs can be formed of segments of wire reinforcing mesh with hooked ends for connecting the two shells forming the sheath. The cross webs provide a support cradle for positioning horizontal bars of reinforcing steel at each desired height level. The cross webs are fabricated from structurally acceptable plate steel, tie-bar stock, or simply a reinforcing grade wire mesh. In this manner, the cross webs become an integral part of the internal reinforcement of the wall formed with the permanent outer sheathing.

The invented system allows for more flexibility than prior art systems and allows a form-fill wall to be constructed according to the structural requirements desired. The form-sheath system of this invention results in a permanent sheathed wall that has a variety of uses whether it be for housing, building construction, water tanks, lined lagoons, panel structures, or any of a variety of uses to which the construction is structurally suited.

SUMMARY OF THE INVENTION

The form-fill concrete wall system of this invention utilizes a form-sheath to construct an in-place concrete wall. The form-sheath system has a panel assembly that functions both as a support for a reinforcing rod matrix and a containing form for the poured concrete. The panel assembly is constructed with two separate shells that have a locking mechanism that engages a series of cross-webs such that the shells can be quickly locked together. Each shell is designed such that the assembly can be erected using a number of the cross-webs to space the shells and support reinforcing rod or bar placed horizontally in pre-formed cradles in the cross-webs. Different construction procedures may be used for walls of different height and thickness.

The form-sheath is filled with concrete and the concrete adheres to the cross-webs and the inside wall of the two shells. The shells become an integral element of the completed wall and form an outer, protective sheath. The cross-webs are selected to provide the desired width of the wall. By proper selection of materials, the shells forming the sheath can be weather resistent, and resistent to acid or corrosive environments. Preferably for most industrial applications, the composition of the shell can be formulated with the use of recycled plastics. Protective sheathing that is specially formulated will likely be required only for specific applications. The form-sheath is preferably fabricated in integral, wide panels, for example, of standard four foot widths. A series of panels assembled together forms the sheaths or inner and outer walls of any desired length, width and height. The length of assembled panels can be varied as desired by simple cutting with saws designed to cut conventional plastic sheeting or thin plywood. By forming panels in standard ten and twenty foot lengths, the form-sheathing can comprise a modular system for a variety of different structures. Being preferably formed of plastic of some type, the sheaths not only are easily cut to size, but may be cut to provide any type of wall with ports, windows, or other openings that may be desired. Naturally, for structures that exceed three or four feet in height, a backup support form with suitable struts for maintaining the integrity of the shell will be required.

Key to the form-sheath system is a locking mechanism that allows panels to be interlocked by the cross-webs. Since concrete has extraordinarily high compressive strength, but only minimal strength in tension, the steel reinforcing in the form of conventional rod or bar provides the horizontal tensile strength to the structures formed with these unique forms. Seams formed during the interconnection process are sealed with a bead of sealant such that the structures created are waterproof, and may be advantageously used as vertical walls for tanks and other hydraulic systems. Ends and corners can be formed with strip sections of panel material glued together to form the appropriate corner configuration using high-strength plastic cements.

BRIEF DESCRIPTION OF THE DRAWINGS

FIG. 2A is a top view of the structure of FIG. 1 without concrete and showing end plates, cross webs and reinforcing steel.

FIG. 2B is a top view of an alternate embodiment of a panel assembly forming a sheath for a wall structure.

FIG. 3A is a partial top view of a typical panel locking strip for the middle of a bent, wire mesh cross web.

FIG. 3B are typical panel locking strips for the butted ends of two panels with an interconnection strip and a steel plate cross web.

FIG. 3C is a panel end locking strip with a plastic, end plate having a connection edge.

FIG. 3D is an alternate embodiment of a middle, combination locking strip for the middle of a panel that is also an end strip.

DETAILED DESCRIPTION OF THE PREFERRED EMBODIMENTS

Figure 1:
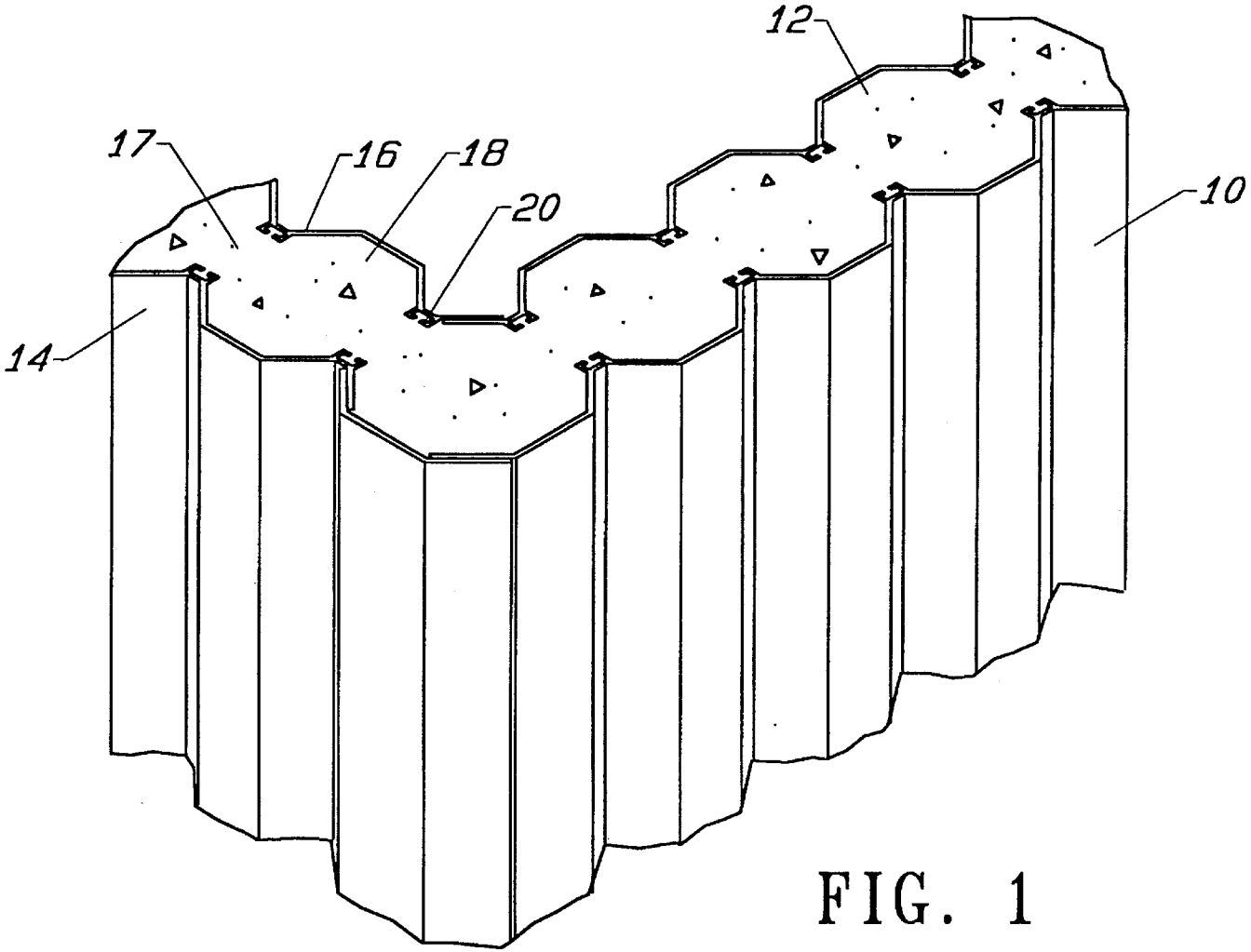
FIG. 1 is a form-fill concrete wall segment partially fragmented showing the top corner of completed wall structure using the panels to form the assembled sheath.

This invention relates to a form-fill concrete wall and more specifically to a form-sheathing system for constructing a concrete vertical wall that has a finish siding that comprises the form. Referring to the drawings, the form-sheath system, designated generally by the reference numeral 10 is shown as a concrete filled wall 12 in FIG. 1. The concrete filled wall 12 has an outside shell 14 coupled to an inside shell 16 by a series of cross webs 17, with the void between shells 14 and 16 filled with concrete 18. Referring to FIG. 2A, the inside shell 16 and outside shell 14 are constructed with a series of web locking strips 20. Locking strips 20 are either middle strips 19 integral with the inner surface of a shell panel 21 to form a joint free panel section 22 as shown in FIG. 3A, or are end strips 23 integral with the edge of a shell panel to allow interconnection of two panels 21 by means of a coupling strip 24 as shown in the cross section of FIG. 3B.

Figures 4A, 4B, 4C, 4D, 4E, 4F:
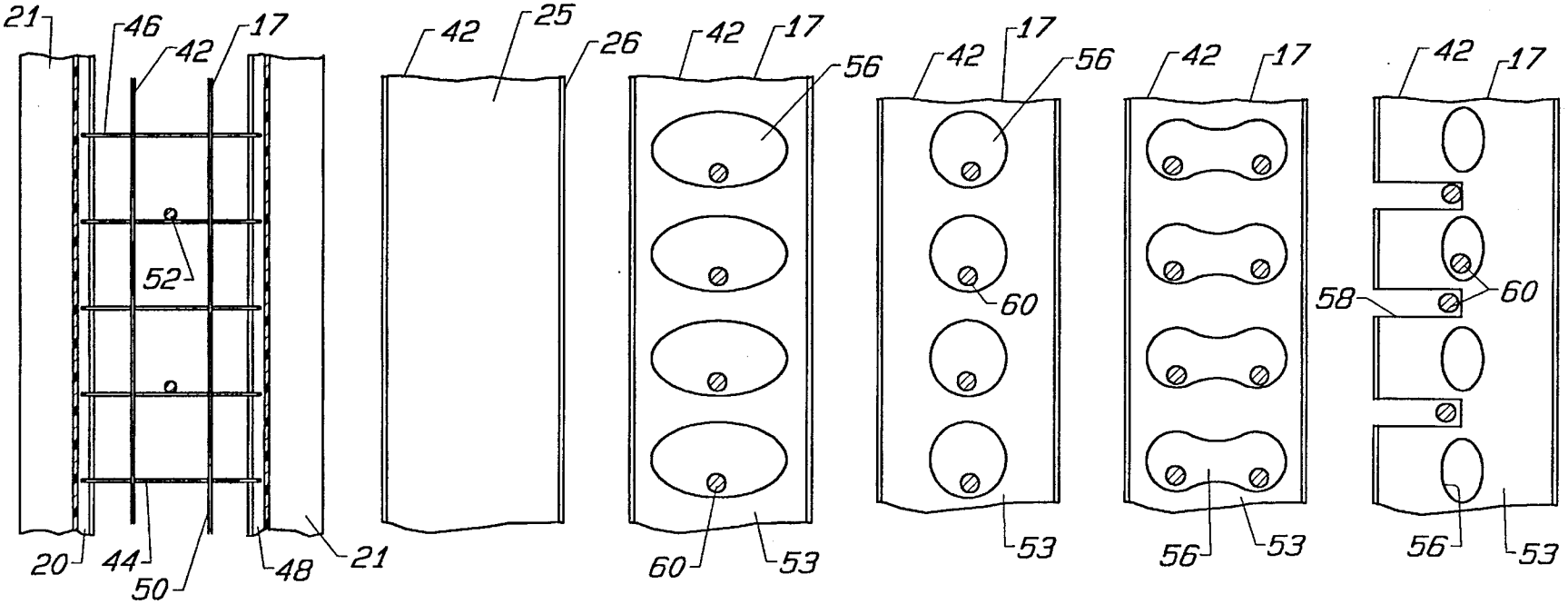
FIG. 4A is a partial end view of a wall structure with the sheath panels and a first alternate interlocking web structure showing a wire mesh cross web.
FIG. 4B is a partial view showing a plastic, end-piece cross web for use in the end structure of FIG. 3C.
FIG. 4C is a partial view showing a steel-plate, cross web with oval, flow-through holes.
FIG. 4D is a partial view showing a steel-plate, segmented cross web with circular flow-through holes.
FIG. 4E is a partial view showing a steel-plate, cross web with oblong flow-through holes.
FIG. 4F is a partial view showing a steel plate cross web with combined slotted and oval flow-through holes.

Referring to FIGS. 3C, the panel 21 having the special locking end strip 23 along the side edge connects to an end plate 25, also shown in FIG. 4B with an interconnecting edge strip 26 for completing the sheath encasement of the end of a wall or other structure. Similarly, a combination locking strip 27 as shown in FIG. 3D provides a middle locking strip, or, when the panel is cut down the center of the locking strip 27 along the knife guide 28 provides an end locking strip along the side edge, similar to those shown in FIG. 3B. The use of side edge locking strips is preferred when the panels are fabricated from sheet metal.

When the preferred material of the panels 21 is a plastic, such as polyvinyl chloride (PVC), sections of panel can be interconnected by a lap joint using an adhesive to produce a joint equal or greater in strength than the single thickness sheet material itself. Because the panels are fabricated with a corrugated surface having V-shaped grooves with an inclination angle of 45° from the flat outer surface, a simplified method of interconnection is employed using the lap joints shown in FIGS. 2A and 2B. In this simplified system, the panels 21 have no locking strips at their side edges 31 and interconnection of panels is accomplished by overlapped segments of panel, or panel segments cut from panels, or specially produced panel segments, all using the same simple locking strip 20 shown in FIG. 3A.

In FIGS. 2A and 2B, alternatives for forming wall corners 32 with similar inside lap joints 33 and different outside lap joints 34 are shown. Additionally, adjacent panels may be interconnected with a V-segment 35 having lap joints 36, 37 with the side edges 31 of the panel 21. End plates 38 are formed of panel segments with the locking strip cut-off as shown in FIG. 2A, or panel segments 39 joined with a panel segment spacer 40 to accommodate for expanded wall thickness, as shown in FIG. 2B.

The inside and outside shells, 16 and 14, respectively, are preferably fabricated in standard size panels, for example 4 foot×10 foot panels that form panel sections of standard size with or without coupling strips along their side edges. In order to accommodate the design of inexpensive structures of variable dimension, the use of shell panels 21 having locking strips 20, as shown in FIG. 3A, are preferred for simplicity, such that any structure can be fabricated using standardized or modular pieces with overlapped joints cut and assembled on-site.

Referring now to FIGS. 4A–4F, a series of alternate interconnectors are shown for interconnecting the connection strips of opposed panels to form the spaced walls of a form-sheath. It is to be understood that the interconnectors 42 may be of different widths to accommodate the required spacing between the spaced wall panels. The interconnectors 42 comprise the cross webs 17 shown in FIGS. 4A and 4C–F, and the end plate 25 shown in FIG. 4B and discussed with reference to FIG. 3C.

The cross web 17 of FIG. 4A is of simple construction and comprises a wire mesh 44 with horizontal members 46 having ends with a right angle bend that alternates in direction from member to member to form a projected "T" as shown in FIG. 3A. The ends of the horizontal members 46 engage the key-slots 48 in the connector strip 20 on the panels 21, which are shown in cross section in FIG. 4A. The horizontal members 46 of the wire mesh are fixed to vertical members 50 and provide a stable cross web with maximum allowance for flow through of concrete. Lightweight reinforcing rod 52 may be laid horizontally on the horizontal members 46 of the wire mesh for added strength.

Alternative sheet metal cross webs 53 are shown in FIGS. 4C–4F and are formed of stamped metal plate with side edges 54 having a T construction for installation into the key slots 48 of the connector strips as shown in the exemplar of FIG. 3B. The T construction may be formed by bent tabs along the edge that alternate in a manner similar to the ends of the horizontal members of the wire mesh. In this manner, the cross webs can be fabricated from inexpensive stamped sheet metal.

As shown in FIGS. 4C–4F, the alternate cross webs 53 have flow-through holes 56 and/or slots 58 to allow concrete to flow through the cross webs and to provide a cradle for horizontally disposed reinforcing bar 60. As shown, the holes 56 may be of different configuration including oval (FIG. 4C), round (FIG. 4D), or, oblong (FIG. 4E). Other configurations, or the addition of additional small holes may improve the flow-through of a concrete slurry without affecting the structural integrity and function of the cross webs as a spacer for the wall panels.

After coupling the inside and outside shells 14 and 16, an oversized aperture remains between hexagonal wall segments 61 as indicated in FIG. 2A such that concrete can communicate in part from one wall segment to the other and provide a continuous protective coating over the reinforcing rod. As can be appreciated, the horizontal reinforcing rod 60 provides the major strength along the horizontal direction to maintain the integrity of the ultimate wall structure formed by a concrete filled wall using the form sheath system. The cross webs provide the cross ties to maintain the desired spacing between shells.

A principle advantage of using the form-sheath system of this invention is in the reduced assembly time required for erecting a wall structure with installed cross webs and arranging the internal structural reinforcing rods into a strong lattice or matrix.

Figure 7:
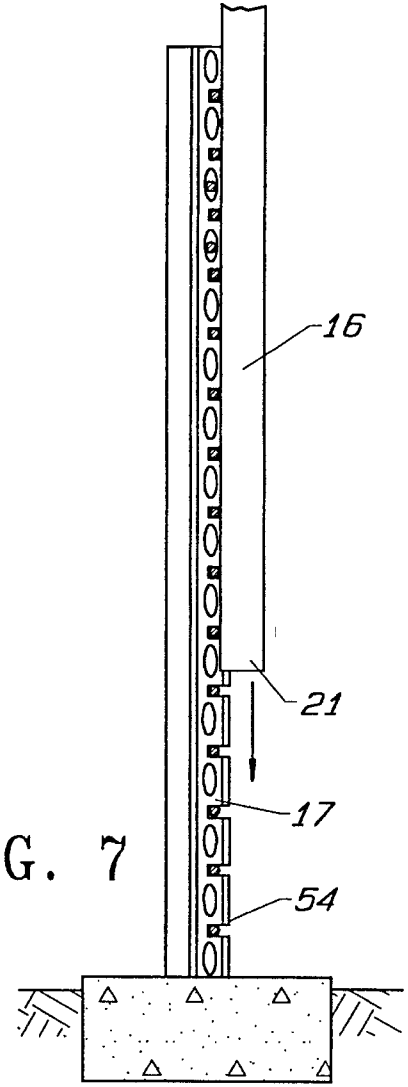
FIG. 7 is the wall structure of FIG. 4 in a final stage of erection.
Figure 6:
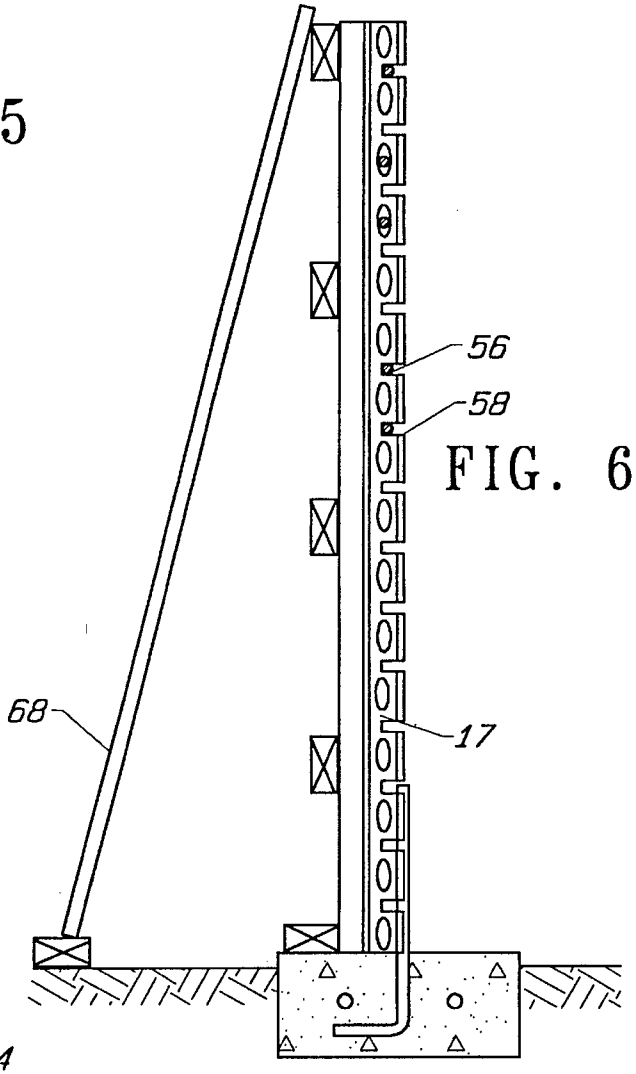
FIG. 6 is the wall structure of FIG. 5 in a partial stage of erection.
Figure 5:
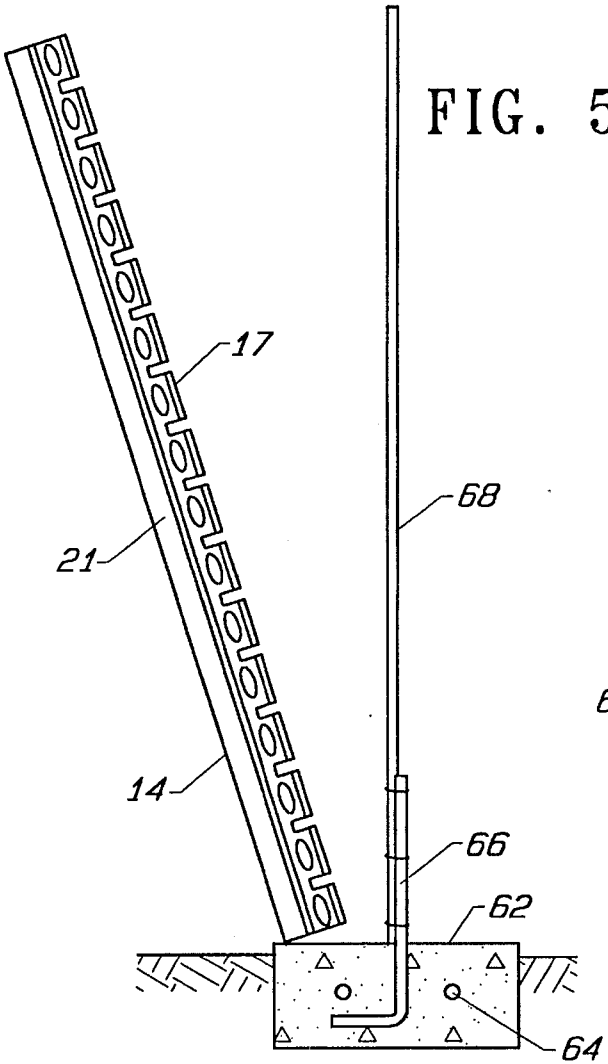
FIG. 5 is a schematic view of a wall structure in an early stage of erection.

Referring now to FIGS. 5–7, one method of erecting a wall structure utilizing the form-sheath system of this invention is shown. For smaller structures or where access to the ends of the wall is available for insertion of reinforcing bar, assembly is simpler than that described in the following description. In general, a footing 62 having standard steel reenforcement 64 includes a series of vertically positioned reinforcing bar 66 that is spaced to position the reinforcing bar 66 substantially centrally in each segment of a octagonal wall segment 61 as shown in FIG. 2A. Referring to FIG. 5, a series of panels 21 are interconnected together with one of the alternate means previously disclosed to form a light-weight wall shell 14. The shell is fitted with cross webs 17, here the type shown in FIG. 4F. The shell is then raised into place and supported by an appropriate timber reinforcing structure 68. In this vertical position, shown in FIG. 6, the first shell 14 is interlaced with a series of horizontal reinforcing bar 60 that are set into slots 58 that are uniformly spaced along the length of the panel segments in the cross webs 17. The cross webs 17 that include slots 58 are especially used when horizontal reinforcing bar 60 cannot be installed from the end of the wall structure being formed. Where possible, reinforcing bar 60 is installed in the openings 56 of the cross webs. The size and spacing of the reinforcing bar or rod 60 is largely dependent on the use to which the structure is intended to be put. For example, where substantial hydraulic pressures may place the wall in horizontal tension, reinforcing bar that is larger in size and greater in number, should be utilized than where the wall structure is simply used as a warehouse or container for granular material. When placing the horizontal reinforcing bar 60 in the slots 58, the vertical reinforcing bar 68 can be positioned and tied to the horizontal bar and to the reinforcing bar 66 projecting from the footing 62. In this manner a matrix or lattice is formed that provides the structural strength necessary for any of a variety of uses.

As shown in FIG. 7, the opposite wall shell 16 is raised to engage the connecting strips (not visible) on the inside of the panels 21 with the T-shaped side edges 54 of the cross webs 17. The wall shell is slid down to the footing 62 to form the wall sheath. It is to be understood that a bracing structure 64 is used during the concrete pour to insure the wall structure is maintained in an upright position.

Other methods of assembly, particularly for wall of less height can be used, for example, the cross web 17 can be segmented as shown in 4D and a horizontal bar 60 threaded through holes in a series of web sections partially installed in the top of spaced wall shells and lowered into position. The process is repeated until the assembly is completed. Where the access to the ends of a wall is provided, the wall shells and cross webs are first assembled and dropped over vertical reinforcing bar with the horizontal bar fed through the holes in the cross webs from the open ends of the wall before closure.

Upon curing, the concrete bonds with the reinforcing bar and panels and locks the various panels together into a unitary wall.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A form-fill wall structure for forming a sheathed concrete wall comprising:

first and second substantially parallel wall panels spaced a predefined distance from one another, the panels being fabricated of a water impervious material;

interconnection means on each wall panel adapted to engage interconnecting cross webs;

a plurality of interconnecting, metallic cross webs having ends, the ends being engaged with the interconnection means on each wall panel to maintain the wall panels in a spaced, interconnected relationship; and, end containing means for forming a form structure adapted to receive a concrete slurry, wherein the wall panels and cross webs are part of a unitary wall when the form structure is filled with concrete, wherein the wall panels have elongated corrugations and when first and second wall panels are positioned in a spaced, parallel arrangement to form the form structure, the corrugations being vertically oriented with a series of alternating flat segments and V-shaped segments, the V-shaped segments of opposed panels being inwardly directed forming a series of vertical constrictions in the form structure wherein the V-shaped segments each have an apex and the interconnection means on the wall panel is at each apex, wherein the cross webs engage the interconnection means and interconnect the spaced panels at the constrictions in the forms structure, the corrugations and cross webs forming a series of substantially octagonal wall segments.

2. The form-fill wall structure of claim 1 wherein the wall panels are fabricated of a metal sheet material.

3. The form-fill wall structure of claim 1 wherein the wall panels are fabricated of a plastic sheet material.

4. The form-fill wall structure of claim 1 wherein the cross-webs are positioned between the wall segments and are constructed to permit concrete slurry to flow through the crosswebs from segment to segment.

5. The form-fill wall structure of claim 1 wherein the side edges of adjacent wall panels include a locking strip and the connector means comprises an elongated coupling strip simultaneously engaging the locking strips on adjacent edges of adjacent panels.

6. The form-fill wall structure of claim 1 wherein the interconnection means comprises oppositely arrange, elongated slot structures in the wall panels and wherein the cross webs comprise a section of wire mesh having a series of bent wire ends that engage the slot structures and interconnect the wall panels.

7. The form-fill wall structure of claim 1 wherein the interconnection means comprises oppositely arranged, elongated slot structures in the wall panels and wherein the cross webs comprise a sheet metal plate having flow through holes and side edges having locking tabs that engage the slot structures and interconnect the wall panels.

8. The form-fill wall structure of claim 7 wherein the sheet metal plate is formed in a series of segments, wherein the segments are stackable in a series in the slot structures of the wall panels to form a composite cross web.

9. The form-fill wall structure of claim 1 wherein the ends containing means comprise end connectors with side edges, the wall panels having opposed side edges at a wall end, wherein the side edges of the end connectors engage and interconnect the side edges of the wall panels at the wall end.

10. The form-fill wall structure of claim 9 wherein the side edges of the end connectors overlap the side edges of the wall panels at the wall end and the edges are engaged with an adhesive.

11. The form-fill wall structure of claim 10 wherein the form structure is filled with concrete to form a unitary wall.

12. The form-fill wall structure of claim 11 including further, vertical and horizontal reinforcing steel in the space between the wall panels.

13. The form-fill wall structure of claim 1 wherein the connector means comprises an elongated interconnection strip.

14. The form-fill wall structure of claim 13 wherein the elongated interconnection strip overlaps adjacent edges of adjacently position panels and couples the edges with an adhesive interposed in the overlap.

* * * * *